US009206707B2

(12) United States Patent
Bindingnavale Ranga

(10) Patent No.: US 9,206,707 B2
(45) Date of Patent: Dec. 8, 2015

(54) METHOD AND A SYSTEM OF ARRANGING TURBINE STAGES FOR SATURATED STEAM APPLICATIONS

(71) Applicant: Krishna Kumar Bindingnavale Ranga, Bangalore (IN)

(72) Inventor: Krishna Kumar Bindingnavale Ranga, Bangalore (IN)

(73) Assignee: Krishna Kumar Bindingnavale Ranga, Karnataka (IN)

( * ) Notice: Subject to any disclaimer, the term of this patent is extended or adjusted under 35 U.S.C. 154(b) by 119 days.

(21) Appl. No.: 14/049,391

(22) Filed: Oct. 9, 2013

(65) Prior Publication Data

US 2014/0102100 A1 Apr. 17, 2014

(30) Foreign Application Priority Data

Oct. 11, 2012 (IN) ..... 4239/CHE/2012

(51) Int. Cl.

| | |
|---|---|
| ***F01K 13/02*** | (2006.01) |
| ***F01B 31/00*** | (2006.01) |
| ***F01K 7/34*** | (2006.01) |
| ***F01K 7/22*** | (2006.01) |
| ***F01D 21/02*** | (2006.01) |
| ***F01K 7/24*** | (2006.01) |

(52) U.S. Cl.

CPC ..... *F01K 7/345* (2013.01); *F01D 21/02* (2013.01); *F01K 7/223* (2013.01); *F01K 7/226* (2013.01); *F01K 7/24* (2013.01); *F01K 13/02* (2013.01)

(58) Field of Classification Search

CPC ..... F01K 7/345; F01K 7/24; F01K 7/223; F01K 7/226; F01K 13/02; F01D 21/02

USPC ..... 60/653, 654, 677–679, 646, 657

See application file for complete search history.

(56) References Cited

U.S. PATENT DOCUMENTS

| | | | | |
|---|---|---|---|---|
| 3,518,830 | A * | 7/1970 | Dunnavant et al. | 60/657 |
| 3,803,836 | A * | 4/1974 | Gilli | 60/698 |
| 3,848,138 | A * | 11/1974 | Park | 290/40 R |
| 4,510,755 | A * | 4/1985 | Gartmann et al. | 60/657 |
| 6,422,017 | B1 * | 7/2002 | Bassily | 60/653 |
| 6,780,458 | B2 * | 8/2004 | Seth et al. | 427/201 |
| 2011/0056201 | A1 * | 3/2011 | Kluge et al. | 60/653 |

* cited by examiner

*Primary Examiner* — Hoang Nguyen

(74) *Attorney, Agent, or Firm* — Barry Choobin; Patent 360 LLC

(57) ABSTRACT

The various embodiments herein provide a safety system for multiple turbine stages for saturated steam applications. The system comprises an isolating system having the inter-stage pipes for isolating the turbine stages and for transferring steam from one stage to another stage. A draining system is connected to each seal housing, inlet casing, exit casing and inter stage pipe to drain out a condensed steam vapor during a passage of steam between two successive stages. The draining system comprises drain pipes and a condensate pot for collecting and storing condensed steam. A thermodynamic trap is attached to the drain pipes and condensate pot for removing the condensed steam vapors collected in the condensate pot and drain pipes without significant steam leakage. A control system is provided for detecting and stopping high speed rotation of rotor disk in turbine assembly.

18 Claims, 6 Drawing Sheets

METHOD AND A SYSTEM OF ARRANGING TURBINE STAGES FOR SATURATED STEAM APPLICATIONS

CROSS-REFERENCE TO RELATED APPLICATION

This application claims the priority of the Indian Provisional Patent application with serial number 4239/CHE/2012 filed on Oct. 11, 2012 with title, "A Method and a System of Arranging Turbine Stages for Saturated Steam Applications" and the contents of which is incorporated in entirety.

BACKGROUND

1. Technical Field

The embodiments herein generally relate to steam turbines and particularly relates to an arrangement of the turbine stages in a steam turbine for saturated steam applications. The embodiments herein more particularly relates to a method and a system for removal of condensate from steam turbines and a system for preventing cascading blade failures.

2. Description of the Related Art

Turbines are rotating machines which convert the energy contained in a working fluid to useful work. In general, a turbine comprises a shaft and a circular disk or a ring. The circumference of the circular disk comprises a series of blades. The series of blades are shaped and aligned based on the rotational speed of the turbine, energy in the fluid and application. There are numerous types of turbines depending on the type of input, such as steam, water, wind, gas, etc.

The steam turbines generally have one or more stages, but multiple stage turbines are also well known for utilizing the working fluid, such as steam, more effectively. The multiple stage turbines are generally the axial steam turbines in which a series of rotors or disks are aligned onto the same rotating shaft one after the other. Steam in superheated state, which is the steam heated beyond a saturation temperature, is preferred for use in the steam turbines. But the steam in saturated state is used widely across the industries. The steam is produced when the water is heated. When all the water has changed phase to steam, the steam is said to be 'saturated'. When the saturated steam is further heated, a superheated steam is produced. The saturated steam offers an easy and controlled operation and hence is widely preferred by the industries for use in the processes.

The reason for not using the saturated steam in all the industries is mainly due to the characteristics of the saturated steam. The saturated steam is in a vapor phase which is just above the water/liquid phase. When the saturated steam is passed from one stage to another stage, a part of the steam is condensed and the water droplets are formed due to an expansion of the saturated steam. The jet of water droplets is accelerated through the nozzle and the jet of water droplets hits the blades of the rotor disk at very high speed and creates pitting on them. If the rotor disk is continued to operate in such conditions, the blades are likely to fail. Further, in case of an axial multistage turbine disk arrangement, the water droplets are carried over to all the stages to deteriorate the condition of the blades at each stage. The existing methods and arrangements do not provide a solution for safeguarding the multistage turbines against such damage.

Also in the event of a blade failure, where the turbine blade or a part of the blade breaks away from the turbine disk, the projectiles are bound to strike the subsequent stages causing a catastrophic failure. For the steam turbines with four or fewer stages, this method provides an alternative arrangement in which each turbine stage is isolated from the other to prevent a cascading blade failure.

Hence there is need for a system and a method to arrange the multiple stages of a steam turbine for the saturated steam applications. Also, there is a need for a system and a method to arrange the multiple stages of steam turbine to prevent a deterioration of the steam turbine in the saturated steam applications. Further, there is a need for a method and a system for facilitating the multiple extractions and injections in the steam turbines. Still further there is a need for an arrangement of the multiple stages to prevent a cascading blade failure in the steam turbines.

The abovementioned shortcomings, disadvantages and problems are addressed herein and which will be understood by reading and studying the following specification.

OBJECTS OF THE EMBODIMENTS

The primary object of the embodiments herein is to provide a method and a system for arranging the multiple stages of a steam turbine to protect the steam turbine from wear and tear during the saturated steam applications.

Another object of the embodiments herein is to provide a method and a system for isolating the multiple stages of the steam turbines from each other for safeguarding the turbine against the cascading blade failures.

Yet another object of the embodiments herein is to provide a method and a system for transferring the steam from one stage to another stage through a piping in a multistage steam turbine in a saturated steam application.

Yet another object of the embodiments herein is to provide a method and a system for arranging the multiple stages of steam turbine to facilitate the multiple extractions and injections of the working fluid.

Yet another object of the embodiments herein is to provide a method and a system for draining out the suspended water droplets from the wet steam in a steam turbine.

These and other objects and advantages of the embodiments herein will become readily apparent from the following detailed description taken in conjunction with the accompanying drawings.

SUMMARY

The various embodiments herein provide a safety system for multiple turbine stages for saturated steam applications. The system comprises an isolating system for isolating a plurality of turbine stages in turbines for a saturated steam application and a draining system The isolating system comprises a plurality of inter stage pipes, and each inter stage pipe is connected between two successive turbine stages to transfer steam for one stage to another stage. The draining system is connected to each inter stage pipe, seal housing and steam manifold to drain out a condensed steam vapor during a passage of steam from one stage to another stage. The draining system comprises a condensate pot for collecting and storing condensed steam vapors and a thermodynamic trap attached to the condensate pot for removing the condensed steam vapors collected in the condensate pot without any steam leakage and. The condensate pot is not required in the case of steam manifolds and seal housings. Only a thermo dynamic trap is provided in the draining system connected to the seal housing and steam manifold.

According to an embodiment herein, a draining system comprising drain valves and thermodynamic traps is fitted to the seal housings and manifolds.

According to an embodiment herein, the condensate pot is fitted to the inter stage pipe.

According to an embodiment herein, the condensate pot comprises a blind flange with an opening for connecting a drain pipe.

According to an embodiment herein, the thermodynamic trap is connected to the drainpipe through a T-joint.

According to an embodiment herein, the thermodynamic trap is provided with a first drain valve to remove the condensed steam vapor collected at the thermodynamic trap.

According to an embodiment herein, the T-joint is connected to a second drain valve at one end.

According to an embodiment herein, the first drain valve is always kept open during an operation of a turbine.

According to an embodiment herein, the second drain valve is kept closed during the operation of the turbine and the second rain valve is opened to remove the condensed steam vapor, only when the thermodynamic trap has failed.

According to an embodiment herein, the thermodynamic trap is kept shut till a preset level of condensed steam vapor is accumulated in the condensate pot.

According to an embodiment herein, the thermodynamic trap is opened to remove the condensed steam vapor, when the condensed steam vapor collected in the condensate pot reaches a preset level. The thermodynamic trap is adopted to remove water with minimal leakage of steam.

According to an embodiment herein, a control system is provided for detecting and stopping a high speed rotation of the rotor disk in turbine assembly According to an embodiment herein, the control system comprises a speed sensing wheel along with a speed pick up system mounted over a low speed shaft in the turbine to detect and measure a speed of rotor disk.

According to an embodiment herein, the control system comprises a programmable logic controller to receive the output of the speed sensing wheel to stop a rotation of the rotor disk.

According to an embodiment herein, the programmable logic controller measures a speed of the rotor disk based on the output of the speed sensing wheel and wherein the programmable logic controller provides a command to stop a rotation of the rotor disk, when the measured speed of the rotor disks exceed a threshold level.

According to an embodiment herein, the programmable logic controller provides a command to close a steam inlet control valve to stop a supply of steam to the turbine to stop a rotation of the rotor disk, when the measured speed of the rotor disks exceed a threshold level.

According to an embodiment herein, the safety system further comprises an abradable coating provided at an inner surface of a shroud which is arranged directly above a circular periphery of the rotor disk. The abradable coating is provided to prevent a metal to metal contact of blades of the rotor with the shroud, when the rotor strikes the shroud during a high speed rotation.

According to an embodiment herein, the abradable coating comprises a soft material. The soft material is phosphor bronze.

According to an embodiment herein, the abradable coating has a thickness of 5 mm.

The various embodiments herein provide a method of protecting multiple stages of turbine in saturated steam applications. The method comprises the steps of: connecting a plurality of stages of the steam turbine through a plurality of inter stage pipes, fitting a condensate pot to each inter stage pipe to drain out a condensed steam during a passage of steam from one stage to another stage in the plurality of stages and attaching a thermodynamic trap to seal housings, steam manifolds and condensate pots to remove a condensed steam vapor collected in the condensate pot.

According to an embodiment herein, the thermodynamic trap is kept shut till a preset level of condensed steam vapor is accumulated in the condensate pot.

According to an embodiment herein, the thermodynamic trap is opened to remove the condensed steam vapor, when the condensed steam vapor collected in the condensate pot reaches a preset level. The thermodynamic trap is adopted to remove water with minimal leakage of steam.

The various embodiments herein provide a method and a system for arranging the multiple stages of a steam turbine to protect the steam turbine from wear and tear during the saturated steam applications. The embodiments of the present invention also provide a method and a system for arranging the multiple stages in a steam turbine and utilizing the steam effectively. According to an embodiment, the multiple stages of the steam turbine are isolated from each other in a saturated steam application. The steam is transferred from one stage to another stage through a piping in a saturated steam application. A draining system for removing/draining the water droplets from the saturated steam is provided at each stage of the steam turbine to protect the rotor blades and other exposed parts of the steam turbine from the jet of high speed water droplets in the saturated steam application.

According to an embodiment herein, the system comprises a gearbox, a gearwheel, at-least one high speed shaft, at-least one low speed shaft, a coupling hub, an inlet casing in which a nozzle is enclosed, a turbine disk and sealing system, an outlet casing, at-least one distance piece, a plurality of thermodynamic traps and a plurality of pipes. The gearbox is formed integrally with the turbine modules. The gearwheel is mounted on a low speed shaft and assists in achieving a desired speed based on a requirement. The gearbox houses at-least one high speed shaft with an integral pinion. The low speed shaft is arranged between the two high speed shafts or next to one high-speed shaft. The low speed shaft is driven by the gear wheel which meshes with the integral pinions of the high speed shafts. The low speed shaft is coupled to a generator or other equipment requiring to be driven through a coupling. A set of turbine rotor disks are fixed at the ends of the high speed shaft. To prevent an excessive leakage of the steam, the ring seals are provided and the ring seals are housed inside the seal housings. The inlet and outlet casings, which are used to direct the steam from one stage to another are clamped to the gearbox by means of the distance piece. The inlet and outlet casings are provided with draining systems comprising thermodynamic traps and drain valves.

According to an embodiment herein, a method for arranging the multiple stages of a steam turbine to protect the steam turbine from wear and tear during the saturated steam applications is provided. The method involves isolating the multiple stages of the steam turbines from each other in a multi-stage steam turbine in a saturated steam application. The steam is transferred from one stage to another stage through a piping in a saturated steam application. The water droplets from the saturated steam is removed or drained at each stage of the steam turbine to protect the rotor blades and other exposed parts of a steam turbine from the jet of high speed water droplets.

The method comprises supplying a saturated steam through a pipe into the first stage of the steam turbine. The steam is passed onto a rotor through an inlet manifold before being accelerated through a nozzle. The steam then exits the stage after having rotated the turbine disk, through an exit manifold. The expansion of the saturated steam through the turbine causes the steam to become 'wet steam'. As the 'wet' steam passes through the inlet and exit manifolds, it loses the heat to the walls of the manifolds and the condensate formed is collected at the bottom of the manifolds and removed with the help of drains and ejected using a thermodynamic trap. An inter-stage pipe is provided between the two stages. One end of the pipe is connected to the exit manifold of the first stage. The other end of the manifold is connected to the inlet manifold of second stage through a pipe. A draining system is attached to the inter-stage pipe to drain out any condensate collected in the pipe. The draining system comprises a condensate pot and a thermodynamic trap which helps to eject the condensate when the level of the condensate collected in the thermodynamic trap reaches a certain level. The density of the water droplets is more than that of the saturated steam. When the saturated steam with the suspended water droplets is passed through the inter-stage pipe, it is passed in a swirling fashion thereby throwing the heavier water droplets outward causing the heavier water droplets to slide down the walls of the pipe. The water droplets are collected in the condensate pot while the steam is continuously passed to the next stage.

According to an embodiment herein, the method further comprises, passing the saturated steam from the first stage to the second stage through the piping. Similar to first turbine stage, the second turbine stage comprises a rotor disk mounted to the high speed shaft. The steam is passed through the rotor disk and is further expanded. The water droplets that are formed during an expansion process are collected in the manifolds and inter-stage piping as described previously. Similarly, the above process is followed/repeated at the third and fourth stages of the steam turbine and the steam is exited from the outlet casing of the fourth stage.

According to an embodiment herein, a thermodynamic trap is adopted for draining out the water droplets along with a condensate pot. When a preset volume of water is collected in the condensate pot and thermodynamic trap, the thermodynamic trap, which is connected below the condensate pot, is opened and the water in the thermodynamic trap is drained out. The thermodynamic trap is closed once the water has been ejected and water starts filling in the condensate pot again. Water is ejected with minimal leakage of steam through the trap.

According to an embodiment herein, the isolated arrangement of the multiple stages in the steam turbine enables to extract the working fluid flexibly from any intermediate stage. The extracted working fluid, preferably steam, from the intermediate stage is utilized for use in auxiliary processes. The isolated arrangement of the multiple stages in the steam turbine enables to feed the working fluid at any intermediate stage in the steam turbine easily and flexibly. The feeding and the bleeding of the working fluid are performed through the inter-stage pipes connected between the successive stages. The piping arrangement enables to bleed the steam from any stage for any auxiliary processes.

According to an embodiment herein, a speed sensing wheel along with a speed pick up system is mounted over the low speed shaft to measure a speed of the rotor disk. The speed sensing wheel comprises a plurality of gear tooth on the outer periphery. The plurality of tooth is used to achieve speed detection with a high precision. The rotation of the speed sensing wheel is sensed by a speed pick up system for detecting the number of rotations and then the speed of the rotating disk is determined. A programmable logic controller based control system is used for controlling the turbine. When the speed of the rotor disk exceeds a threshold limit, the control system stops the supply of working fluid to the turbine by closing the inlet control valve and hence stops the turbine.

According to an embodiment herein, a method and a system for preventing a cascading blade failure in a multiple stage steam turbine is provided. When a rotor disk of the steam turbine rotates at a very high speed, in the event of a blade failure or the turbine rubbing the shroud, there is an imbalance in the rotor. The imbalance causes a spike in vibrations and this is sensed by a vibration sensor. If the vibration of the rotor disk exceeds a threshold limit, the control system stops the supply of working fluid to the turbine by closing the inlet control valve and hence stops the turbine.

In the case of a blade being dislodged from the disk, the dislodged blades or a part of it comes out as high speed projectiles and remains confined in the stage which has failed. The dislodged blade is stopped from colliding with the other stages by the isolated design of the turbine stages. All the stages of the steam turbine are isolated from each other and are only connected through the inter-stage pipes. Thus the present invention prevents the cascading blade failures of further stages by arranging the multiple stages in isolation from each other. The isolation of the two or more stages is provided by housing each stage of the steam turbine in separate or independent enclosures.

These and other objects and advantages of the embodiments herein will become readily apparent from the following detailed description taken in conjunction with the accompanying drawings.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The other objects, features and advantages will occur to those skilled in the art from the following description of the preferred embodiment and the accompanying drawings in which.

Figure 1:
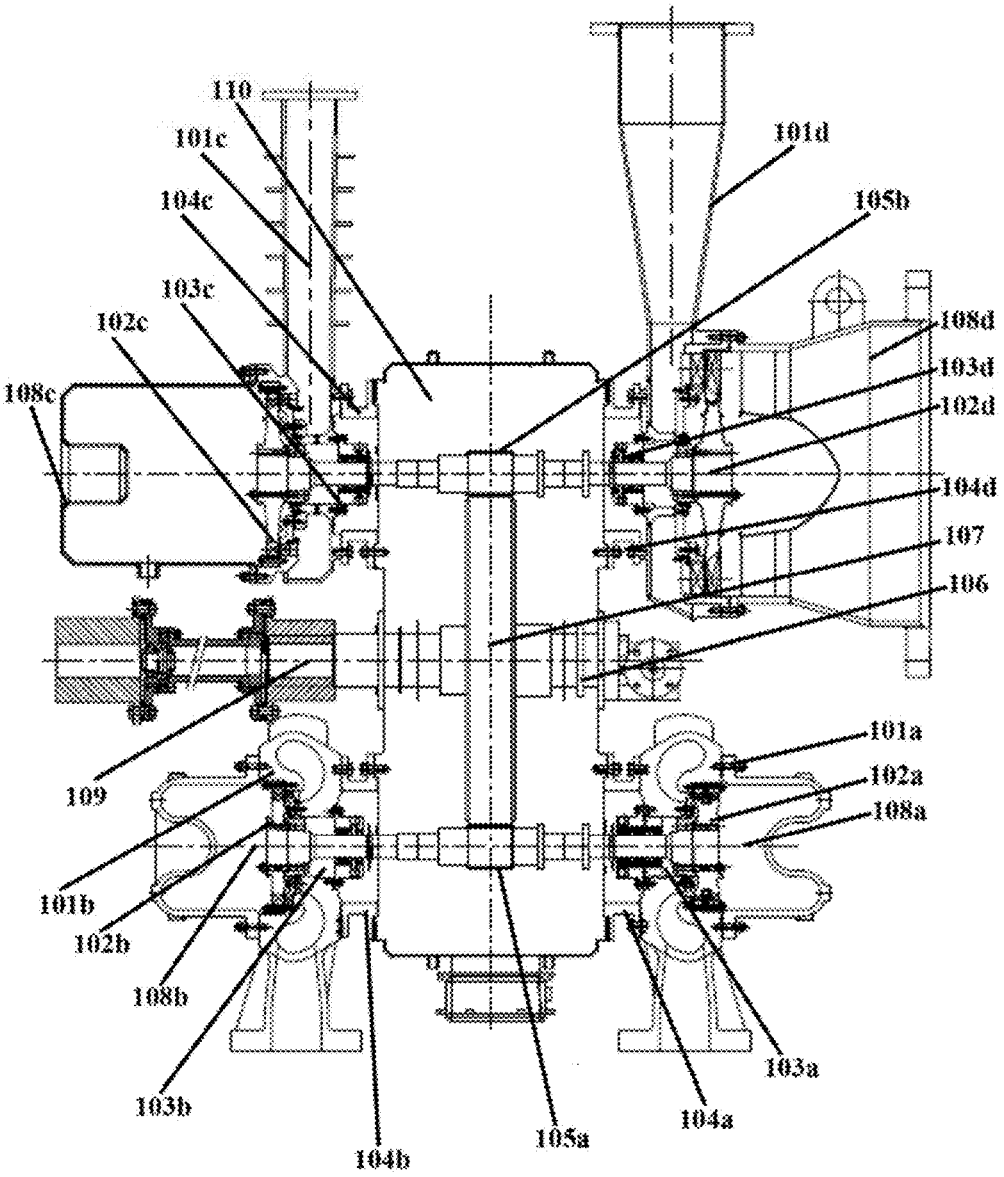
FIG. 1 illustrates a sectional view of an isolated four stage steam turbine assembly, according to an embodiment herein.

Although the specific features of the embodiments herein are shown in some drawings and not in others. This is done for convenience only as each feature may be combined with any or all of the other features in accordance with the embodiments herein.

DETAILED DESCRIPTION OF THE EMBODIMENTS

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The various embodiments herein provide a safety system for multiple turbine stages for saturated steam applications. The system comprises an isolating system for isolating a plurality of turbine stages in turbines for a saturated steam application and a draining system The isolating system comprises a plurality of inter stage pipes, and each inter stage pipe is connected between two successive turbine stages to transfer steam for one stage to another stage. The draining system is connected to each inter stage pipe, seal housing and steam manifold to drain out a condensed steam vapor during a passage of steam from one stage to another stage. The draining system comprises a condensate pot for collecting and storing condensed steam vapors and a thermodynamic trap attached to the condensate pot for removing the condensed steam vapors collected in the condensate pot without any steam leakage and. The condensate pot is not required in the case of steam manifolds and seal housings. Only a thermo dynamic trap is provided in the draining system connected to the seal housing and steam manifold.

According to an embodiment herein, a draining system comprising drain valves and thermodynamic traps is fitted to the seal housings and manifolds.

According to an embodiment herein, the condensate pot is fitted to the inter stage pipe.

According to an embodiment herein, the condensate pot comprises a blind flange with an opening for connecting a drain pipe.

According to an embodiment herein, the thermodynamic trap is connected to the drainpipe through a T-joint.

According to an embodiment herein, the thermodynamic trap is provided with a first drain valve to remove the condensed steam vapor collected at the thermodynamic trap.

According to an embodiment herein, the T-joint is connected to a second drain valve at one end.

According to an embodiment herein, the first drain valve is always kept open during an operation of a turbine.

According to an embodiment herein, the second drain valve is kept closed during the operation of the turbine and the second rain valve is opened to remove the condensed steam vapor, only when the thermodynamic trap has failed.

According to an embodiment herein, the thermodynamic trap is kept shut till a preset level of condensed steam vapor is accumulated in the condensate pot.

According to an embodiment herein, the thermodynamic trap is opened to remove the condensed steam vapor, when the condensed steam vapor collected in the condensate pot reaches a preset level. The thermodynamic trap is adopted to remove water with minimal leakage of steam.

According to an embodiment herein, a control system is provided for detecting and stopping a high speed rotation of the rotor disk in turbine assembly According to an embodiment herein, the control system comprises a speed sensing wheel along with a speed pick up system mounted over a low speed shaft in the turbine to detect and measure a speed of rotor disk.

According to an embodiment herein, the control system comprises a programmable logic controller to receive the output of the speed sensing wheel to stop a rotation of the rotor disk.

According to an embodiment herein, the programmable logic controller measures a speed of the rotor disk based on the output of the speed sensing wheel and wherein the programmable logic controller provides a command to stop a rotation of the rotor disk, when the measured speed of the rotor disks exceed a threshold level.

According to an embodiment herein, the programmable logic controller provides a command to close a steam inlet control valve to stop a supply of steam to the turbine to stop a rotation of the rotor disk, when the measured speed of the rotor disks exceed a threshold level.

According to an embodiment herein, the safety system further comprises an abradable coating provided at an inner surface of a shroud which is arranged directly above a circular periphery of the rotor disk. The abradable coating is provided to prevent a metal to metal contact of blades of the rotor with the shroud, when the rotor strikes the shroud during a high speed rotation.

According to an embodiment herein, the abradable coating comprises a soft material. The soft material is phosphor bronze.

According to an embodiment herein, the abradable coating has a thickness of 5 mm.

The various embodiments herein provide a method of protecting multiple stages of turbine in saturated steam applications. The method comprises the steps of: connecting a plurality of stages of the steam turbine through a plurality of inter stage pipes, fitting a condensate pot to each inter stage pipe to drain out a condensed steam during a passage of steam from one stage to another stage in the plurality of stages and attaching a thermodynamic trap to seal housings, steam manifolds and condensate pots to remove a condensed steam vapor collected in the condensate pot.

According to an embodiment herein, the thermodynamic trap is kept shut till a preset level of condensed steam vapor is accumulated in the condensate pot.

According to an embodiment herein, the thermodynamic trap is opened to remove the condensed steam vapor, when the condensed steam vapor collected in the condensate pot reaches a preset level. The thermodynamic trap is adopted to remove water with minimal leakage of steam.

The various embodiments herein provide a method and a system for arranging the multiple stages of a steam turbine to protect the steam turbine from wear and tear during the saturated steam applications. The embodiments of the present invention also provide a method and a system for arranging the multiple stages in a steam turbine and utilizing the steam effectively. According to an embodiment, the multiple stages of the steam turbine are isolated from each other in a saturated steam application. The steam is transferred from one stage to another stage through a piping in a saturated steam application. A draining system for removing/draining the water droplets from the saturated steam is provided at each stage of the steam turbine to protect the rotor blades and other exposed parts of the steam turbine from the jet of high speed water droplets in the saturated steam application.

According to an embodiment herein, the system comprises a gearbox, a gearwheel, at-least one high speed shaft, at-least one low speed shaft, a coupling hub, an inlet casing in which a nozzle is enclosed, a turbine disk and sealing system, an outlet casing, at-least one distance piece, a plurality of thermodynamic traps and a plurality of pipes. The gearbox is formed integrally with the turbine modules. The gearwheel is mounted on a low speed shaft and assists in achieving a desired speed based on a requirement. The gearbox houses at-least one high speed shaft with an integral pinion. The low speed shaft is arranged between the two high speed shafts or next to one high-speed shaft. The low speed shaft is driven by the gear wheel which meshes with the integral pinions of the high speed shafts. The low speed shaft is coupled to a generator or other equipment requiring to be driven through a coupling. A set of turbine rotor disks are fixed at the ends of the high speed shaft. To prevent an excessive leakage of the steam, the ring seals are provided and the ring seals are housed inside the seal housings. The inlet and outlet casings, which are used to direct the steam from one stage to another are clamped to the gearbox by means of the distance piece. The inlet and outlet casings are provided with draining systems comprising thermodynamic traps and drain valves.

According to an embodiment herein, a method for arranging the multiple stages of a steam turbine to protect the steam turbine from wear and tear during the saturated steam applications is provided. The method involves isolating the multiple stages of the steam turbines from each other in a multi-stage steam turbine in a saturated steam application. The steam is transferred from one stage to another stage through a piping in a saturated steam application. The water droplets from the saturated steam is removed or drained at each stage of the steam turbine to protect the rotor blades and other exposed parts of a steam turbine from the jet of high speed water droplets.

The method comprises supplying a saturated steam through a pipe into the first stage of the steam turbine. The steam is passed onto a rotor through an inlet manifold before being accelerated through a nozzle. The steam then exits the stage after having rotated the turbine disk, through an exit manifold. The expansion of the saturated steam through the turbine causes the steam to become 'wet steam'. As the 'wet' steam passes through the inlet and exit manifolds, it loses the heat to the walls of the manifolds and the condensate formed is collected at the bottom of the manifolds and removed with the help of drains and ejected using a thermodynamic trap. An inter-stage pipe is provided between the two stages. One end of the pipe is connected to the exit manifold of the first stage. The other end of the manifold is connected to the inlet manifold of second stage through a pipe. A draining system is attached to the inter-stage pipe to drain out any condensate collected in the pipe. The draining system comprises a condensate pot and a thermodynamic trap which helps to eject the condensate when the level of the condensate collected in the thermodynamic trap reaches a certain level. The density of the water droplets is more than that of the saturated steam. When the saturated steam with the suspended water droplets is passed through the inter-stage pipe, it is passed in a swirling fashion thereby throwing the heavier water droplets outward causing the heavier water droplets to slide down the walls of the pipe. The water droplets are collected in the condensate pot while the steam is continuously passed to the next stage.

According to an embodiment herein, the method further comprises, passing the saturated steam from the first stage to the second stage through the piping. Similar to first turbine stage, the second turbine stage comprises a rotor disk mounted to the high speed shaft. The steam is passed through the rotor disk and is further expanded. The water droplets that are formed during an expansion process are collected in the manifolds and inter-stage piping as described previously. Similarly, the above process is followed/repeated at the third and fourth stages of the steam turbine and the steam is exited from the outlet casing of the fourth stage.

According to an embodiment herein, a thermodynamic trap is adopted for draining out the water droplets along with a condensate pot. When a preset volume of water is collected in the condensate pot and thermodynamic trap, the thermodynamic trap, which is connected below the condensate pot, is opened and the water in the thermodynamic trap is drained out. The thermodynamic trap is closed once the water has been ejected and water starts filling in the condensate pot again. Water is ejected with minimal leakage of steam through the trap.

According to an embodiment herein, the isolated arrangement of the multiple stages in the steam turbine enables to extract the working fluid flexibly from any intermediate stage. The extracted working fluid, preferably steam, from the intermediate stage is utilized for use in auxiliary processes. The isolated arrangement of the multiple stages in the steam turbine enables to feed the working fluid at any intermediate stage in the steam turbine easily and flexibly. The feeding and the bleeding of the working fluid are performed through the inter-stage pipes connected between the successive stages. The piping arrangement enables to bleed the steam from any stage for any auxiliary processes.

According to an embodiment herein, a speed sensing wheel along with a speed pick up system is mounted over the low speed shaft to measure a speed of the rotor disk. The speed sensing wheel comprises a plurality of gear tooth on the outer periphery. The plurality of tooth is used to achieve speed detection with a high precision. The rotation of the speed sensing wheel is sensed by a speed pick up system for detecting the number of rotations and then the speed of the rotating disk is determined. A programmable logic controller based control system is used for controlling the turbine. When the speed of the rotor disk exceeds a threshold limit, the control system stops the supply of working fluid to the turbine by closing the inlet control valve and hence stops the turbine.

According to an embodiment herein, a method and a system for preventing a cascading blade failure in a multiple stage steam turbine is provided. When a rotor disk of the steam turbine rotates at a very high speed, in the event of a blade failure or the turbine rubbing the shroud, there is an imbalance in the rotor. The imbalance causes a spike in vibrations and this is sensed by a vibration sensor. If the vibration of the rotor disk exceeds a threshold limit, the control system stops the supply of working fluid to the turbine by closing the inlet control valve and hence stops the turbine.

In the case of a blade being dislodged from the disk, the dislodged blades or a part of it comes out as high speed projectiles and remains confined in the stage which has failed. The dislodged blade is stopped from colliding with the other stages by the isolated design of the turbine stages. All the stages of the steam turbine are isolated from each other and are only connected through the inter-stage pipes. Thus the present invention prevents the cascading blade failures of further stages by arranging the multiple stages in isolation from each other. The isolation of the two or more stages is provided by housing each stage of the steam turbine in separate or independent enclosures.

FIG. 1 illustrates a sectional view of an isolated four stage steam turbine assembly, according to an embodiment herein. With respect to FIG. 1, the saturated steam is supplied to the first stage of the four stage steam turbine. The saturated steam is injected into the first stage through the first inlet casing 101*a*. The steam is made to strike the blades of the first rotor disk 102*a* of the first stage. The saturated steam is collected in the first outlet casing 108*a* of the first stage of the steam turbine. A steam leakage is controlled by means of the ring seals which are housed in a seal housing 103*a*. The saturated steam exits from the first stage through a first outlet casing 108*a*. The saturated steam from the first stage enters into the second stage of the steam turbine through the second inlet casing 101*b*. The saturated steam strikes the second rotor disk 102*b* of the second stage steam turbine. The first rotor disk 102*a* of the first stage and second rotor disk 102*b* of the second stage are mounted to the two ends of the first high speed shaft 105*a*. The steam leakage is controlled by means of the ring seals which are housed in a seal housing 103*b*. The saturated steam exits from the second stage of the steam turbine through the second outlet casing 108*b*. The saturated steam from the second stage enters the third stage of the steam turbine through the third inlet casing 101*c*. The third stage comprises a rotor disk 102*c* coupled to a second high speed shaft 105*b*. The saturated steam strikes the third rotor disk 102*b*. The steam leakage is controlled by means of the ring seals which are housed in a seal housing 103*c*. The saturated steam exits the third stage through a third outlet casing 108*c*. The saturated steam from the third stage enters into the fourth stage of the steam turbine through a fourth inlet casing 101*d*. The saturated steam is passed onto the fourth rotor disk 102*d* of the fourth stage. The fourth rotor disk 102*d* of the fourth stage and the third rotor disk 102*c* of the third stage are connected to the second high speed shaft 105*b*. The saturated steam exits the fourth stage of the steam turbine through a fourth outlet casing 108*d*. The steam leakage is controlled by means of the ring seals which are housed in a seal housing 103*d*.

A gearbox 110 houses the gear assembly and encloses the two high speed shafts and one low speed shaft. The first high speed shaft 105*a* and the second high speed shaft 105*b* are connected to the low speed shaft 106 through the integral pinions. The low speed shaft 106 further comprises a gear wheel 107 for coupling with the two high speed shafts 105*a* and 105*b*. The gear wheel 107 on the low speed shaft 106 assists in achieving a desired speed ratio. The low speed shaft 106 is driven by the integral pinions of the two high speed shaft 105*a* and 105*b*. The gearbox 110 is housed securely over the shafts and the gear assembly through the distance pieces of each stage. The four distance pieces 104*a*, 104*b*, 104*c* and 104*d* hold the inlet and exit casings to the gearbox 110 properly. A coupling hub 109 is mounted at the end of the low speed shaft 106. The coupling hub 109 couples with the shaft of the generator or any other equipment which requires to be driven.

Figure 2:
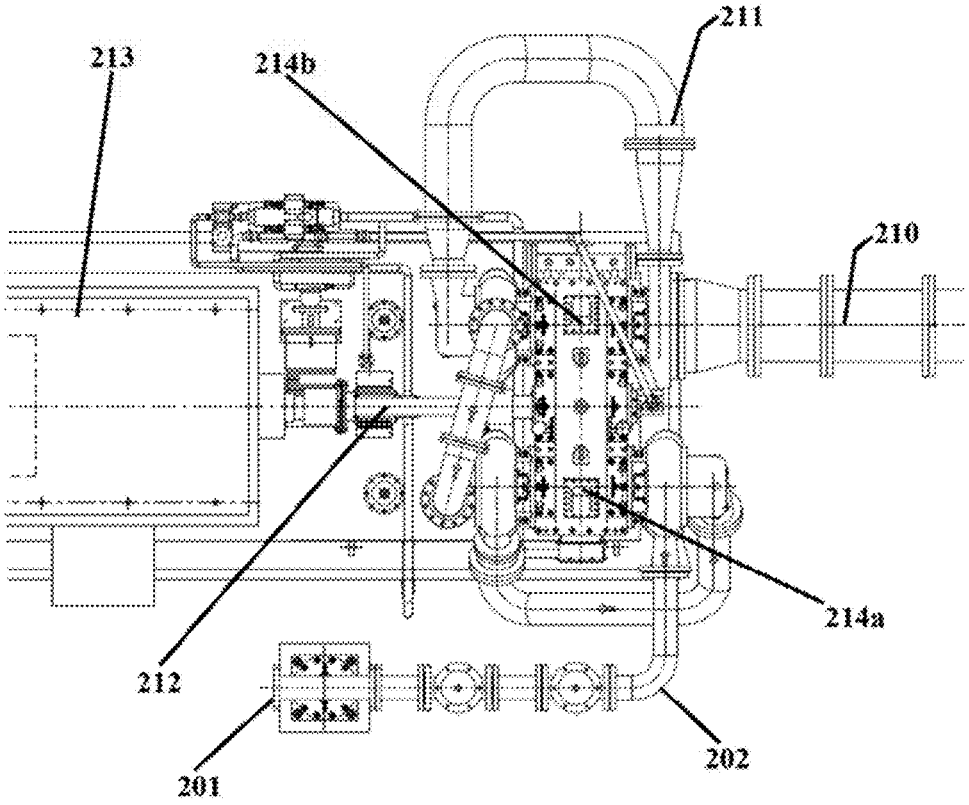
FIG. 2 illustrates a plan view of an isolated four stage steam turbine indicating the piping assembly between the two stages, according to an embodiment herein.

FIG. 2 illustrates a plan view of an isolated four stage steam turbine indicating the piping assembly between the two stages, according to an embodiment herein. With respect to FIG. 2, the steam is supplied through the steam inlet pipe 201. The steam is a saturated steam. The saturated steam passes through a flow control valve and an on/off valve before entering into the first stage of the steam turbine 202. The first stage of the steam turbine comprises a first rotor disk fixed to the first high speed shaft. The first high speed shaft 214*a* is enclosed in the gearbox. The gearbox provides an enclosure for housing the two high speed shafts, a low speed shaft and other gear assembly. The saturated steam expands when passed on to the blades of the rotor disk of the first stage through the nozzle. The expanded saturated steam exits the first outlet casing of the first stage. The first outlet casing of the first stage is linked with the second inlet casing of the second stage through the plurality of pipes. The plurality of pipes between the two stages is referred to as an inter stage pipe 211. The second stage comprises a second rotor disk. The second rotor disk is mounted to the first high speed shaft. The saturated steam passes through the nozzle and strikes on to the blades of the second rotor disk. The saturated steam again undergoes expansion and exits from the second stage through the second outlet casing. The second outlet casing of the second stage is connected to the third inlet casing of the third stage through the inter stage pipes 211. The third stage comprises a third rotor disk mounted to the second high speed shaft. The high speed shaft is adopted between the third stage and the fourth stage. The saturated steam passes through the nozzle and strikes the blades of the third rotor disk. Once again the saturated steam undergoes further expansion and passes on to the fourth stage through the third outlet casing of the third stage. The third outlet casing of the third stage is connected to the fourth inlet casing of the fourth stage through the inter stage pipe 211. The saturated steam enters the fourth stage of the steam turbine comprising a fourth rotor disk. The fourth rotor disk is mounted on to the second high speed shaft 214*b*. The saturated steam is passed through the blades of the fourth rotor disk. The saturated steam is further expanded and is taken out through the fourth outlet casing. The expanded saturated steam is finally is sent to a process or a condenser through a steam outlet 210. The two high speed shafts are coupled through a gear assembly to the low speed shaft. The low speed shaft is further coupled to the generator 213 or any other equipment that is required to be driven. One or more thermodynamic traps are provided at any preferred location on the inter stage piping or at the manifolds. The water droplets travelling with the expanded saturated steam in the pipes are removed by the one or more thermodynamic traps.

Figure 3:
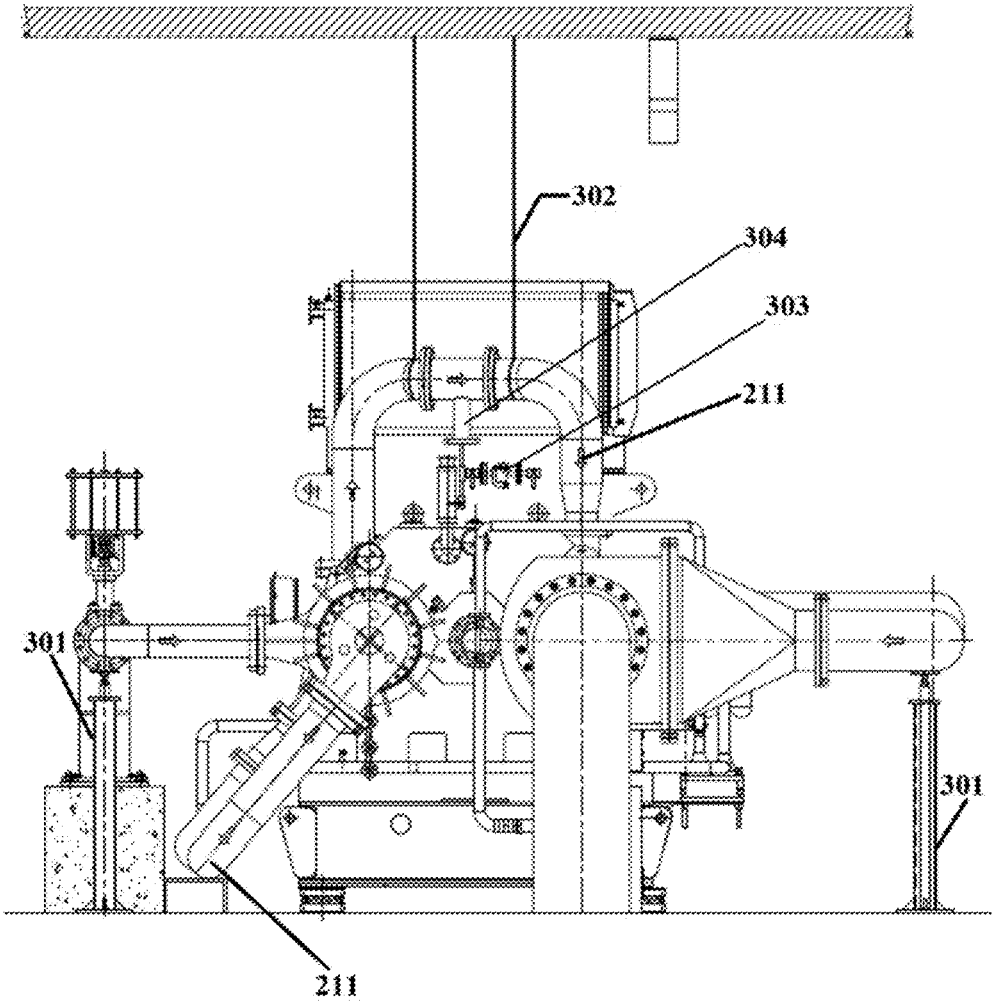
FIG. 3 illustrates the side view of one stage in a four stage steam turbine, according to an embodiment herein.

FIG. 3 illustrates the side view of one stage in a four stage steam turbine, according to an embodiment herein. With respect to FIG. 3, the inter stage pipes 211 are fixed to the turbine for carrying the saturated steam in and out of the different stages. The inter stage pipes 211 are provided with supports 301. The cables 302 also help in holding the inter stage pipes 211 from the top. A thermodynamic trap 303 is provided for draining out the water droplets along with a condensate pot 304. When a preset volume of water is collected in the condensate pot 304 and thermodynamic trap 303, the thermodynamic trap 303 is opened and the water in the thermodynamic trap 303 is drained out. The thermodynamic trap 303 is connected below the condensate pot 304. The thermodynamic trap 303 is closed once the water has been ejected and water started filling in the condensate pot 304 again. Only the water is ejected by the thermodynamic trap 303 and not the steam.

Figure 4:
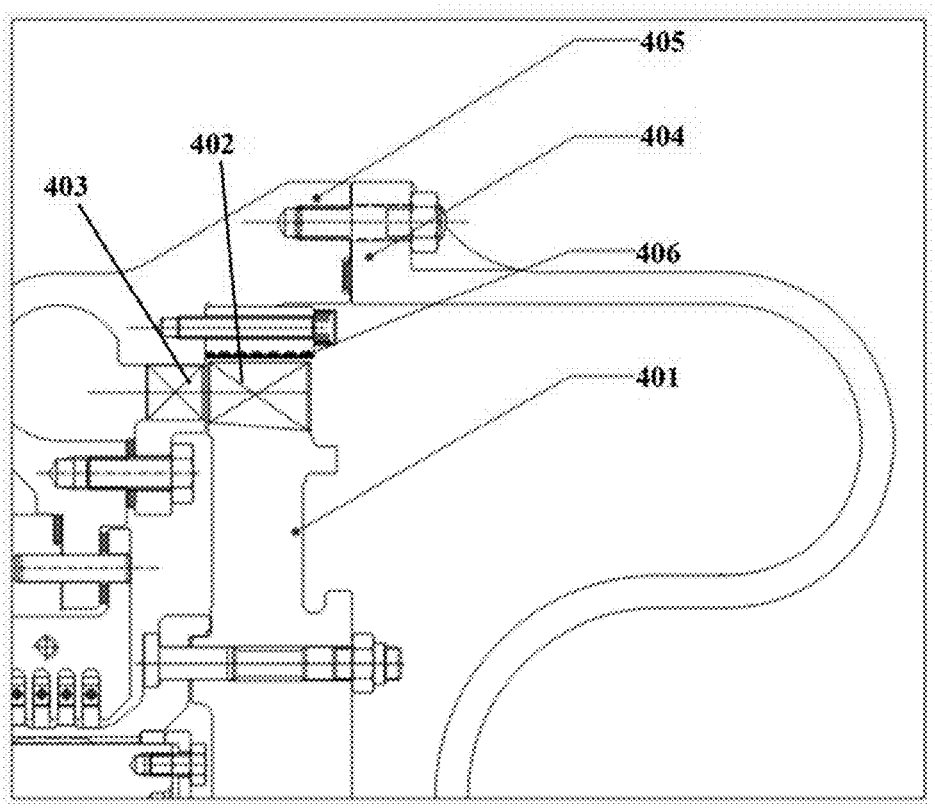
FIG. 4 illustrates a cross sectional view of a rotor disk of any stage with an abradable coating on the inner periphery of the shroud in a steam turbine, according to an embodiment herein.

FIG. 4 illustrates a cross sectional view of a rotor disk of any stage with an abradable coating on the inner periphery of the shroud in a steam turbine, according to an embodiment herein. A rotor disk 401 is mounted at one end of the rotating shaft. The rotor disk 401 is bolted to the shaft for providing an interference fit. The top of the rotor disk 401 adopts an arrangement of the blades 402. The blade arrangement 402 is provided around the outer periphery of the rotor disk 401. A nozzle ring 403 is fixed directly behind the blades 402 of the rotor disk 401. The rotor disk 401 and other turbine assembly are enclosed under two casings namely the inlet casing 405 and the outlet casing 404. The inlet casing 405 houses the integral components of the turbine rotor disk 401. The outlet casing 404 is fixed to the inlet casing 405 through the bolts. The inlet casing also comprises a shroud. The shroud is provided directly above the circular periphery of the rotor disk 401. An abradable coating 406 is applied over the inner periphery of the shroud. The abradable coating 406 is made up of a soft material such as phosphor bronze or any equivalent soft material. The thickness of the abradable coating 406 is around 5 mm. The abradable coating 406 provides an intrinsic safety by safeguarding the blades from a metal to metal contact in the event of the rotor striking the shroud and also safeguards the turbine disk from disk burst.

Figure 5:
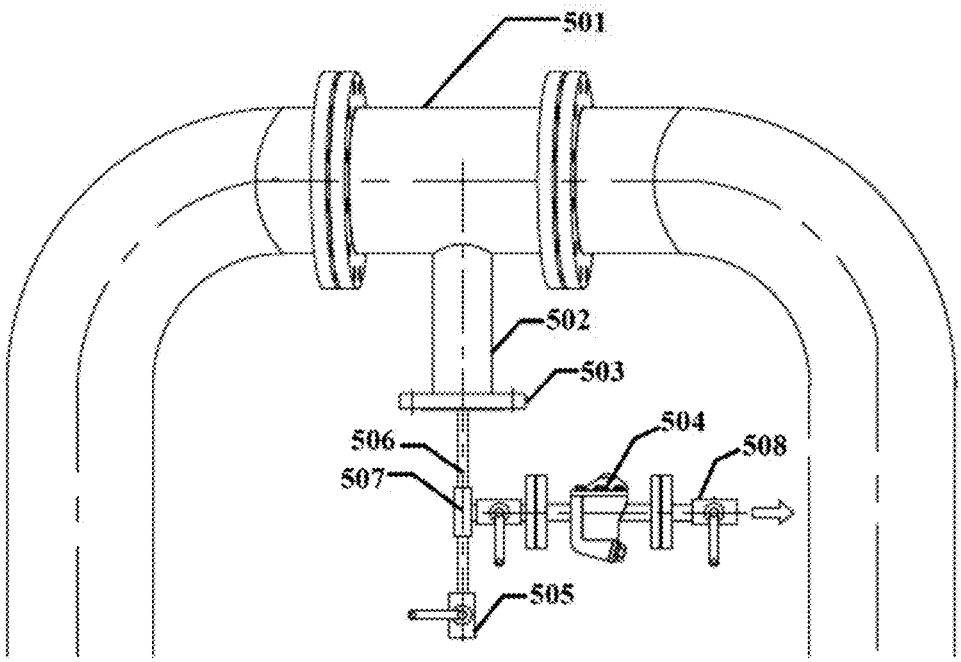
FIG. 5 illustrates the side view of an inter-stage pipe indicating in detail an arrangement for removing condensate between stages of the steam turbine, according to an embodiment herein.

FIG. 5 illustrates the side view of an inter-stage pipe indicating in detail an arrangement for removing condensate between stages of the steam turbine, according to an embodiment herein. The arrangement for removing condensate between any two stages of the steam turbine comprises an inter stage pipe 501 fitted with a condensate pot 502. The condensate pot 502 is welded to the inter stage pipe 501 and the condensate pot 502 comprises a blind flange 503 with an opening for a drain pipe 506 to be attached. The drain pipe 506 comprises a T-joint 507, one end of which is attached to a thermodynamic trap 504 and another to a Valve 505. The thermodynamic trap 504 is further attached to valve 508.

According to an embodiment herein, when steam flows through the inter stage pipe 501 (pipe between stages), steam swirls in the pipeline and some port of the steam condenses on the walls of the pipe. If not removed these droplets collect in the pipeline and are subsequently carried onto the next turbine stage where they can cause damage to the turbine internals.

According to an embodiment herein, the condensate collects in the condensate pot 502. The thermodynamic trap 504 remains shut till the condensate level reaches a certain level. The thermodynamic trap 504 is adopted for facilitating the removal of condensate without much leakage of steam. When enough condensate gets accumulated in the condensate pot 502, the thermodynamic trap 504 opens for ejecting the condensate. The valves 508 remains open throughout the process while the valve 505 remains shut. The valve 505 is opened only in case of failure of the thermodynamic trap 504. The condensate removed is then sent to a tank via a condensate return line. The steam in the inter stage pipe continues to the next stage without the water.

Figure 6:
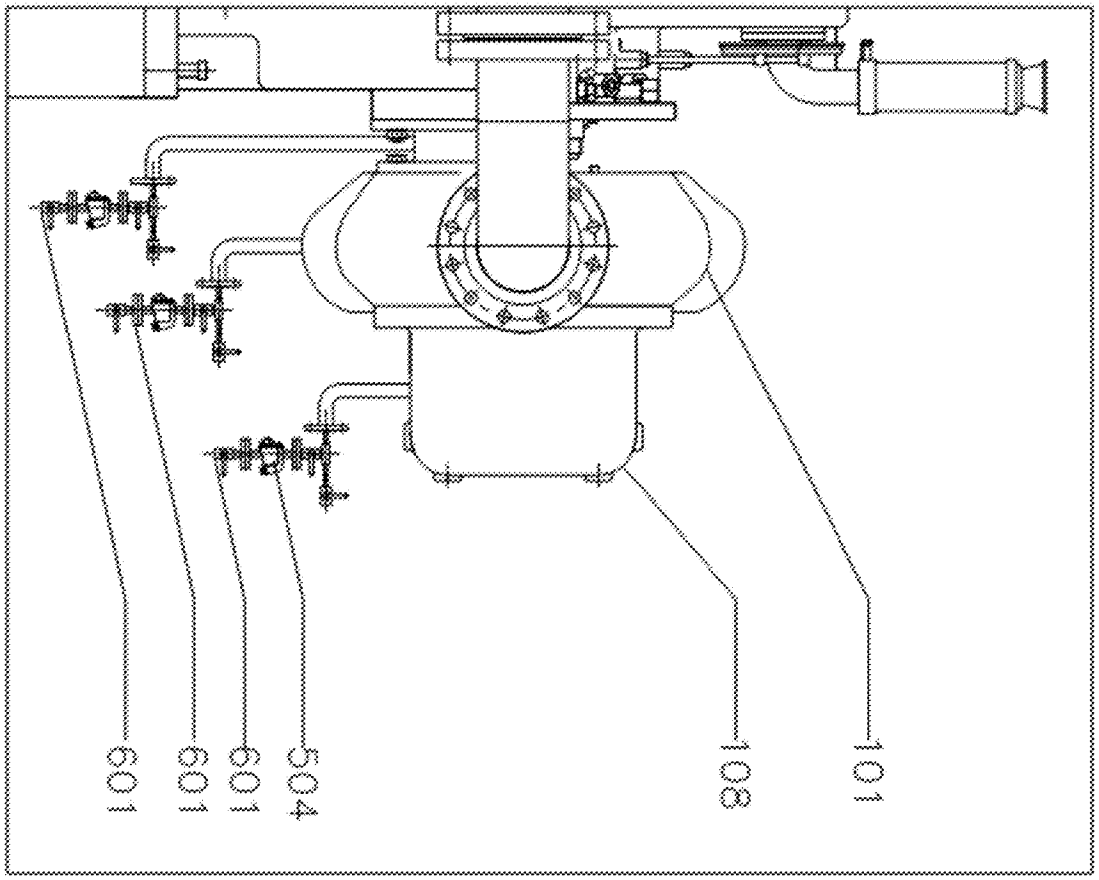
FIG. 6 illustrates a side view of a steam turbine stage indicating in detail the arrangement for draining condensate from the sealing system, inlet casing and exit casing, according to an embodiment herein.

FIG. 6 illustrates a side view of a steam turbine stage indicating in detail the arrangement for draining condensate from the sealing system, inlet casing and exit casing, according to an embodiment herein. The system comprises the drain pipes 601, 601, 601 which is connected to or run from the seal housings, inlet casings 101 and exit casings to a thermodynamic trap 108.

According to an embodiment herein, there are drain valves 508 before and after the thermodynamic trap. These valves remain open during operation of the turbine.

According to an embodiment herein, a T-joint is provided along with a drain valve before the thermodynamic trap to enable draining in case of failure of the trap.

According to an embodiment herein, the condensate is collected in seal housings, inlet casings and exit casings. The thermodynamic trap 504 remains shut till the condensate level in the drain pipes reaches a certain level. The thermodynamic trap 504 is adopted for facilitating the removal of condensate without much leakage of steam. When enough condensate gets accumulated in the drain line, the thermodynamic trap 504 opens the drain line for ejecting the condensate. The condensate removed is then sent to a tank via a condensate return line. The steam in the inter stage pipe continues to the next stage without the water.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. However, all such modifications are deemed to be within the scope of the claims.

It is also to be understood that the following claims are intended to cover all of the generic and specific features of the embodiments described herein and all the statements of the scope of the embodiments which as a matter of language might be said to fall there between.

What is claimed is:

1. A safety system for multiple turbine stages, said system for saturated steam applications comprising:

an isolating system for isolating a plurality of turbine stages in a saturated steam application, and wherein the isolating system comprises a plurality of inter stage pipes, and wherein each inter stage pipe is connected between two successive turbine stages to transfer steam for one stage to another stage;

a draining system connected to each seal housing, inlet casing, exit casing and each inter stage pipe to drain out a condensed steam lap or during a passage of steam from one stage to another stage, and wherein the draining system comprises a condensate pot for collecting and storing condensed steam vapors and a thermodynamic trap; and a control system for detecting and stopping high speed rotation of rotor disk in turbine assembly; and an abradable coating provided at an inner surface of a shroud which is arranged directly above a circular periphery of the rotor disk, and wherein the abradable coating is provided to prevent a metal to metal contact of blades of the rotor with the shroud, when the rotor strikes the shroud during a high speed rotation, wherein the abradable coating comprises a soft material, and wherein the soft material is phosphor bronze.

2. The system according to claim 1, wherein the thermo dynamic trap is attached to the condensate pot for removing the condensed steam vapors collected in the condensate pot without any steam leakage.

3. The system according to claim 1, wherein the drain pipes are fitted to the seal housings, inlet casings and exit casings.

4. The system according to claim 1, wherein the condensate pot is fitted to the inter stage pipe, and wherein the condensate pot comprises a blind flange with an opening for connecting a drain pipe.

5. The system according to claim 1, wherein the thermodynamic trap is connected to the drainpipes through a T-joint.

6. The system according to claim 1, wherein the thermodynamic trap is provided with a first drain valve to remove the condensed steam vapor collected at the thermodynamic trap.

7. The system according to claim 1, wherein the T-joint is connected to a second drain valve at one end.

8. The system according to claim 6, wherein the first drain valve is always kept open during an operation of a turbine.

9. The system according to claim 7 wherein the second drain valve is kept closed during the operation of the turbine and the second drain valve is opened to remove the condensed steam vapor, only when the thermodynamic trap is failed.

10. The system according to claim 1, wherein the thermodynamic trap is kept shut till a preset level of condensed steam vapor is accumulated in the drain pipes or the condensate pot.

11. The system according to claim 1, wherein the thermodynamic trap is opened to remove the condensed steam vapor, when the condensed steam vapor collected in the condensate pot reaches a preset level, and wherein the thermodynamic trap is adopted to remove water without any loss of steam.

12. The system according to claim 1, wherein the control system comprises a speed sensing wheel along with a speed pick up system mounted over a low speed shaft in the turbine to detect and measure a speed of rotor disk.

13. The system according to claim 1, wherein the control system comprises a programmable logic controller to retrieve the output of the speed sensing wheel to stop a rotation of the rotor disk, and wherein the programmable logic controller measures a speed of the rotor disk based on the output of the speed sensing wheel and wherein the programmable logic controller provides a command to stop a rotation of the rotor disk, when the measured speed of the rotor disks exceed a threshold level.

14. The system according to claim 1, wherein the programmable logic controller provides a command to dose a steam inlet control valve to stop a supply of steam to the turbine to stop a rotation of the rotor disk, when the measured speed of the rotor disks exceed a threshold level.

15. The system according to claim 1, wherein the abradable coating has a thickness of 5 mm.

16. A method of protecting multiple stages of turbine in saturated steam applications, the method comprises:

connecting a plurality of stages of the steam turbine through a plurality of inter stage pipes;

fitting drain pipes to seal housings, inlet casings, exit casings and a condensate pot to each inter stage pipe to drain out a condensed steam during a passage of steam from one stage to another stage in the plurality of stages; and attaching a thermodynamic trap to remove a condensed steam vapor collected in the drain pipes and the condensate pot.

17. The method according to claim 16, wherein the thermodynamic trap is kept shut till a preset level of condensed steam vapor is accumulated in the condensate pot and the drain pipes.

18. The method according to claim 16, wherein the thermodynamic trap is opened to remove the condensed steam vapor, when the condensed steam vapor collected in the condensed pot reaches a preset level, and wherein the thermodynamic trap is adopted to remove water with minimal leakage of steam.

* * * * *